US005806678A

United States Patent [19]

Håkansson

[11] Patent Number: 5,806,678

[45] Date of Patent: Sep. 15, 1998

[54] BOX FOR EARPLUGS

[75] Inventor: Jorgen Håkansson, Tyringe, Sweden

[73] Assignee: Dalloz Safety Ab, Billesholm, Sweden

[21] Appl. No.: 819,551

[22] Filed: Mar. 17, 1997

[51] Int. Cl.[6] ..... B65B 43/00; B65B 45/00

[52] U.S. Cl. ..... 206/438; 206/37; 206/806; 215/399; 220/335; 220/751; 224/667; 224/584

[58] Field of Search ..... 206/38, 37, 438, 206/570, 806; 215/235, 237, 395, 399; 220/335, 339, 751; 224/666, 667, 269, 675, 584

[56] References Cited

U.S. PATENT DOCUMENTS

| | | | |
|---|---|---|---|
| 3,163,338 | 12/1964 | Gottsegen | 220/751 X |
| 4,346,810 | 8/1982 | Kneissl | 220/335 X |
| 5,385,282 | 1/1995 | Chen | 224/269 X |
| 5,437,383 | 8/1995 | Stull | 220/335 X |

*Primary Examiner*—Jacob K. Ackun
*Attorney, Agent, or Firm*—IP Group of Pillsbury Madison & Sutro LLP

[57] ABSTRACT

A box for keeping earplugs, including a container part, a lid attached to the container part for closing the container, and elements for attachment and suspension of the box to clothes, a nail or the like. The lid is self-closing by provision of a springing action, and the lid is provided with a protrusion for snap-in locking cooperation with a corresponding indent inside the container part. The attachment element includes a clip having two parts which are flexible in relation to each other in order for a portion of an article, to which the box is intended to be attached, such as a belt, the cloth of a garment, a button, etc., to be inserted between the two flexible parts. The suspension element includes a loop attached to the box.

2 Claims, 3 Drawing Sheets

BOX FOR EARPLUGS

BACKGROUND OF THE INVENTION

The present invention relates to a box with a lid attached thereto and also comprising means for attachment of the box to and/or means for suspension of the box on, for example clothes or a nail. In particular, the present invention relates to a box for containing hearing protection means in the form of earplugs.

It is previously known to provide devices in the form of containers or boxes with lids, for the storing of earplugs. These devices are all intended to be kept in a pocket or similar place.

One of the problems experienced with the existing types of boxes for pocket use is that the box quite often is lost. It simply falls out of the pocket.

Another problem is that the lids on such boxes fall off or opens up too easily, having the result that the earplugs fall out of the box. Either they stay in the pocket, in which case they are bound to become rather dirty, or they fall out of the pocket as well. In both cases, the user is likely to go and provide himself or herself with new earplugs, which actually represents a cost, both in respect of time loss and cost for the new earplugs. The user may also choose not to collect any new earplugs, which could constitute a health problem and eventually result in a hearing deficiency.

Another disadvantage of the existing boxes is that they are difficult to handle, in particular to open, and may even be difficult to find at all in a big pocket, especially bearing in mind that many users may wear protective gloves.

SUMMARY OF THE INVENTION

The purpose of the present invention is to solve the above-described problem by providing a box which is easy to open and close, which in fact closes automatically, on which the lid is safely locked in its closed position, and which is provided with attachment and/or suspension means in order for the box to be safely suspended or attached to the clothes of the user or to any other suitable place.

The present invention solves the above-described problems by providing a box for keeping earplugs comprising a container part and a lid for closing the container part, characterized in that the lid is attached to the container part by means of a first attachment means making the lid self-closing.

The essential advantage of the box according to the present invention is that the lid closes automatically and thereby the earplugs are prevented from falling out of the box and becoming dirty or lost. Accordingly, the box facilitates for the user of the earplugs always have clean and functioning earplugs at his or her disposal whenever he or she needs them.

A particular advantage to be mentioned is that the box comprises second attachment means and/or suspension means such that the box may be attached to or suspended from, the users clothes, for example from a belt, the cloth of a garment, a button, etc. or anywhere else suitable, for easy access. This second attachment means is a clip, but this clip is provided with a semicircular cut-in portion constituting an alternative attachment means. Therefore, the box according to the invention has the further advantage of offering two options for attachment by the user, in addition to the suspension means.

BRIEF DESCRIPTION OF THE DRAWING

The present invention will be further illustrated in the following description with reference made to the accompanying drawings, in which.

DETAILED DESCRIPTION

Figure 1:
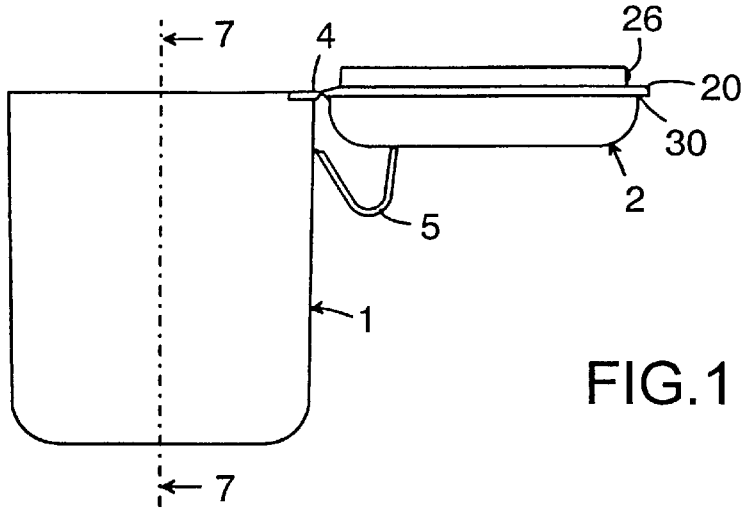
FIG. 1 is a front view of the box according to the invention in its open state.
Figure 2:
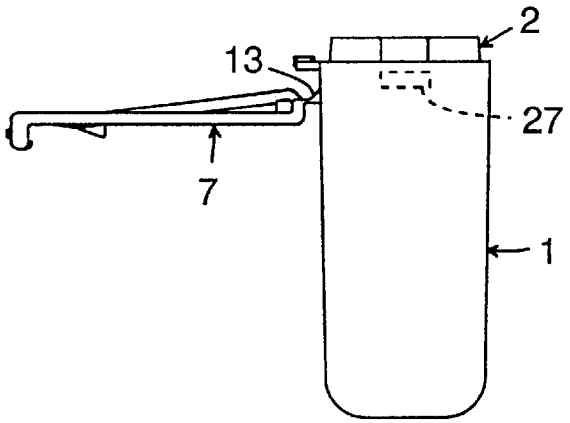
FIG. 2 is a side view of the box with both the attachment means and the suspension means unfolded.
Figure 3:
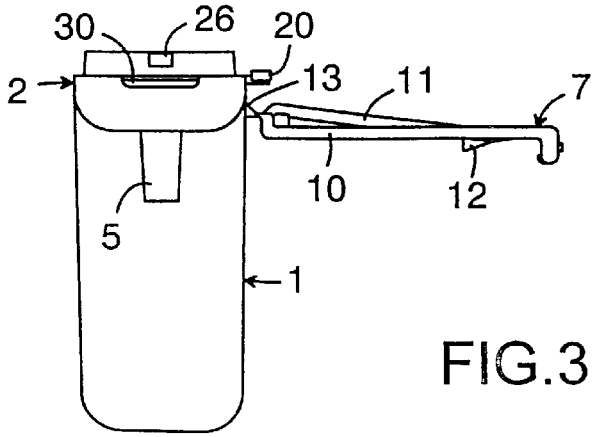
FIG. 3 is a side view of the opposite side of the box.
Figure 4:
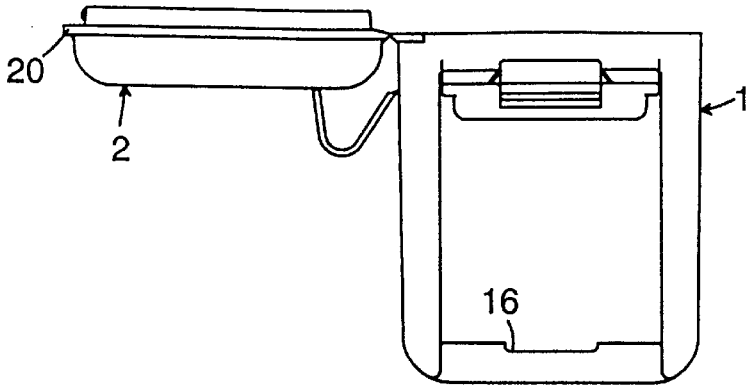
FIG. 4 is a view of the back of the box.
Figure 5:
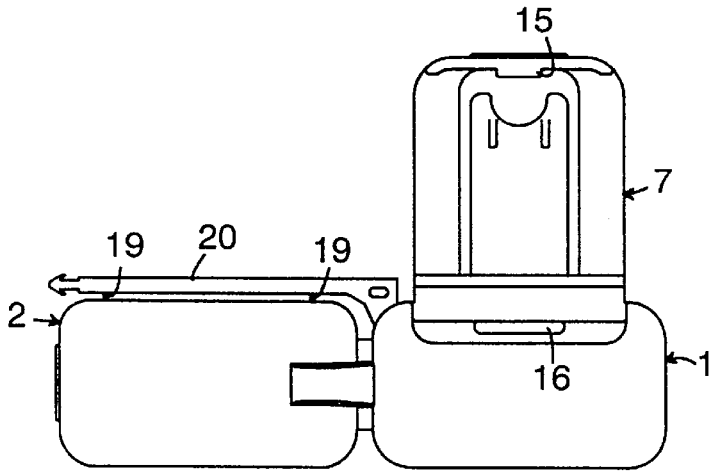
FIG. 5 is a view from above of the box.
Figure 6:
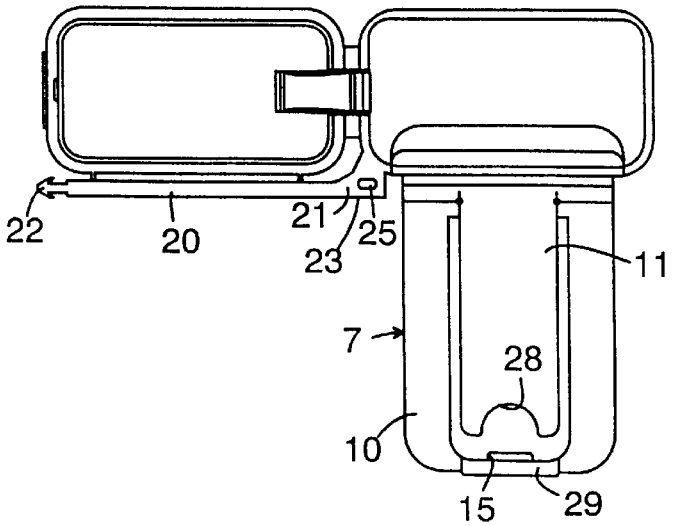
FIG. 6 is a bottom view of the box.
Figure 7:
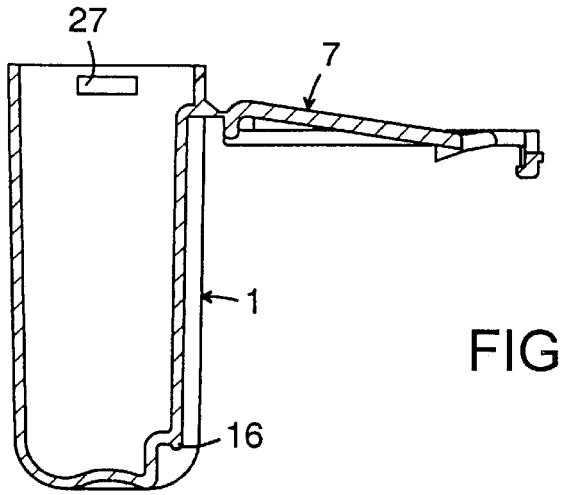
FIG. 7 is a cross section taken on line 7—7 of FIG. 1.
Figure 8:
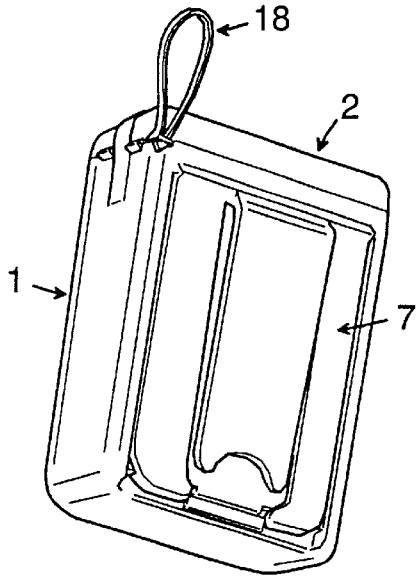
FIG. 8 is a perspective view of the back and bottom of the box in its functional state, with the lid closed and the attachment means and suspension means folded in place for use.
Figure 9:
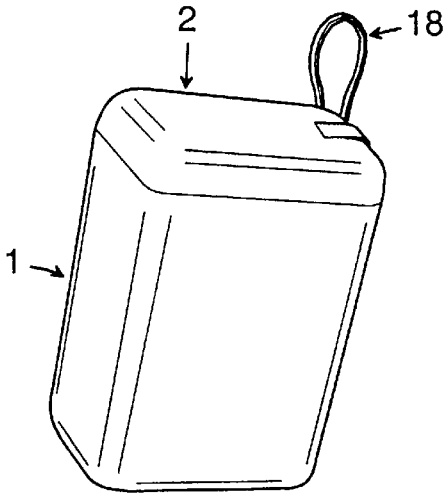
FIG. 9 is a perspective view similar to FIG. 8, but of the front and top of the box.

The preferred embodiment of the box according to the invention is preferably molded. In particular it is injection molded. FIGS. 1–7 illustrate the box as it appears after the molding process, before the attachment means 7 and the suspension means 18 have been folded in order to engage in their functional positions, FIGS. 8 and 9 illustrate the box when the attachment means and suspension means are in their functional positions and these figures show the box as it is normally used.

The box according to the invention comprises a container part 1 with a lid 2. The lid is attached to the container part by means of first attachment means 4,5 which comprise hinge means 4. The hinge is at one end of the lid and, at the other end, the lid is provided with a protrusion 26 which, when the lid is folded over the container part 1, enters into a snap-in locking engagement with a corresponding indent 27 on the inside of the box. The first attachment means also comprise a springing means 5 whose main purpose, however, is not to attach the lid to the container, but to assist in the closing of the lid, and also to ensure that the lid does not open up too easily. When the lid is in its open position, it takes a small effort to close the lid, because the first phase of the closing is performed against the action of the springing means. In a second phase, the closing action is enhanced by the action of the springing means, and the lid is snapped onto the top of the container. Accordingly, once the springing means has passed its point of equilibrium, the lid closes automatically.

The suspension means 18 includes a flexible strip 20, which at one end is attached to the box and at the other end is provided with a locking means 22. In the shown embodiment, this locking means 22 is a hook in the shape of an arrow.

When the box comes from production, the strip 20 is still attached along the side of the lid 2 by means of one or more lips 19. These lips may easily be broken off and the strip is then separated from the lid and may be bent upwards and the arrowshaped hook means 22 can be inserted in a hole 25 in a lug 23 on the box. Thereby a suspension means in the form of a loop 18 is achieved. In the preferred embodiment showed in the accompanying drawings the lug is, in addition to being attached to the container 1, advantageously close to the upper rim of the container, attached to that end of the strip which is opposite the hook end. However, it would be possible and within the scope of this invention to locate the lug in other places on the box which are found convenient. It is possible to provide the hook means 22 on the strip in a different way and also the opening 25 in the lug, under the condition that they can cooperate in engagement in order to form a suspension means. With the aid of this suspension means the box may be suspended, for instance from a nail or a button.

The box also comprises a second attachment means 7. By means of this attachment means the box is intended to be attached to a belt, a pocket, or to any other suitable parts of a garment, etc. This second attachment means is a clip 7 comprising two parts 10, 11 which are flexible in relation to another and it is between these parts that the garment or similar is inserted. Therefore, one of the parts 11, hereinafter referred to as the second part, is slightly resilient and a springing action is thereby achieved in order to improve the function of attachment to the garment. In order to further improve the attachment and to prevent the box from being too easily removed from the garment, the second part 11 is provided with knobs 12 close to its free end.

The clip is attached to the box at its upper end by a hinge means 13 and may be pivoted around the hinge. The first part 10 of the clip 7 is essentially U-shaped and the second part 11 is located between the two legs of the U. The two parts are connected at their upper end, where the hinge also is.

At the lower end, the first part 10 is provided with a protrusion 15 for snap-in locking engagement with a corresponding protrusion 16 on the side of the box, close to its bottom. Normally, when the box is in use, the clip is snapped down. However, if the user finds it more convenient the clip may be loosened from the box when the box is to be attached to, for example, a garment, and after attachment the clip is folded down again and locked on the side of the box. In order to facilitate the unlocking of the clip, the first part 10 is also provided with a second protrusion 29, extending downward from its lower end, by means of which the clip may be lifted and the locking engagement released.

The second part 11 of the clip also offers an alternative second attachment means in the form of a cut-in portion 28 located at its non-hinged end. This cut-in portion preferably has a semicircular shape and it is in particular intended for attachment to a button.

The lid may also be provided with a small protrusion 30 at its end opposite the hinged end by means of which a nail, for example or a thumb may push the lid open.

In the illustrated embodiment, the box is rectangular. However, it is apparent that the box may have any shape that would be convenient for the user or for production reasons, such as square, round, oval, etc.

In the preferred embodiment, the box is manufactured all in one piece, with all its parts integral. This is preferred from a manufacturing point of view, but it is not imperative. The box is preferably made of any suitable plastics material, such as polypropylene, polyamide or polyethylene, and is preferably manufactured through molding, in particular injection molding, though other manufacturing methods may be used, if suitable.

I claim:

1. A box for earplugs comprising:

a container body including peripheral wall defining a cavity having a mouth through which earplugs may be inserted into and taken from the cavity;

a lid;

a first hinge flexibly connecting the lid to the container body for movement between a closed position, in which the lid closes the cavity of the container body, and an open position, in which the cavity of the container body is accessible;

a clip plate having two opposite ends;

a second hinge integrally flexibly connecting the clip plate at one end thereof to said peripheral wall for movement between a first position, in which said clip plate extends downwards from said second hinge beside said peripheral wall, and a second position, which is substantially rotated from said first position, and in which said container body can be hung from said clip plate;

said clip plate including an outer peripheral portion, and an inner portion which is spacedly peripherally surrounded by said outer peripheral portion, except at said one end, where said inner portion is resiliently flexibly connected to said outer peripheral portion;

first and second elements of a connector respectively provided on said peripheral wall and on said outer peripheral portion of said clip plate and arranged to be unsnappably snapped together for releasably maintaining said clip plate in said first position; and a peripheral recess formed in said inner portion of said clip plate adjacent an opposite end of said clip plate from said one end;

said inner portion of said clip plate being arranged to flex to clip over an edge of a belt or clothing article, when said clip plate is in said first position, for clipping the box in place for support, and said inner portion of said clip plate being arranged to flex to trappingly receive a button secured on a clothing article, between said recess and said outer peripheral portion of said clip plate, when said clip plate is in said second position, for hangingly supporting the box from the clothing article.

2. The box of claim 1, wherein:

said box, lid, first hinge, clip plate and second hinge constitute a one-piece, integrally molded article made of plastic material.

* * * * *